US012467244B2

(12) United States Patent
Cipriani et al.

(10) Patent No.: US 12,467,244 B2
(45) Date of Patent: Nov. 11, 2025

(54) HOUSING FOR A FLOW MODIFYING DEVICE

(71) Applicant: Delta Faucet Company, Indianapolis, IN (US)

(72) Inventors: Mark Cipriani, Carmel, IN (US); Darrell Scott Crowe, Zionsville, IN (US); Stephen Boedicker, Whitestown, IN (US)

(73) Assignee: Delta Faucet Company, Indianapolis, IN (US)

( * ) Notice: Subject to any disclaimer, the term of this patent is extended or adjusted under 35 U.S.C. 154(b) by 635 days.

(21) Appl. No.: 17/877,134

(22) Filed: Jul. 29, 2022

(65) Prior Publication Data

US 2024/0035262 A1 Feb. 1, 2024

(51) Int. Cl.
*E03C 1/086* (2006.01)
*E03C 1/084* (2006.01)

(52) U.S. Cl.
CPC ..... *E03C 1/086* (2013.01); *E03C 1/084* (2013.01)

(58) Field of Classification Search
CPC ..... E03C 1/084; E03C 1/086
USPC ..... 239/589.1, 428.5, 590
See application file for complete search history.

(56) References Cited

U.S. PATENT DOCUMENTS

| | | | | |
|---|---|---|---|---|
| 2,998,929 | A | 9/1961 | Aghnides | |
| 3,141,619 | A | 7/1964 | Benjamin et al. | |
| 3,827,636 | A | 8/1974 | Parkison et al. | |
| 4,000,857 | A | 1/1977 | Moen | |
| 4,789,103 | A | 12/1988 | Ruhnke | |
| 5,495,985 | A | 3/1996 | Nehm et al. | |
| 5,845,845 | A * | 12/1998 | Merke | F15C 1/22 239/589.1 |
| 7,431,224 | B2 | 10/2008 | Laker | |
| 7,753,074 | B2 | 7/2010 | Rosko et al. | |
| 8,561,922 | B2 | 10/2013 | Staedtler | |
| 8,646,476 | B2 | 2/2014 | Thomas et al. | |
| 8,881,755 | B2 | 11/2014 | Thomas et al. | |
| 9,033,260 | B2 | 5/2015 | Takano | |
| 10,280,600 | B2 | 5/2019 | Tempel | |
| 2006/0226266 | A1 * | 10/2006 | Russell | B60S 1/52 239/DIG. 3 |
| 2012/0061492 | A1 * | 3/2012 | Peng | E03C 1/084 239/548 |

(Continued)

FOREIGN PATENT DOCUMENTS

| | | | |
|---|---|---|---|
| DE | 102011080794 | A1 | 3/2012 |
| EP | 3208390 | B1 | 10/2020 |

(Continued)

OTHER PUBLICATIONS

Neoperl; Rectangular Faucet Aerators; retrieved on Dec. 28, 2021 from https://www.neoperl.com/global/en/home/products/faucet-aerators/aerator-specialties/rectangular-aerators/, 23 pages.

*Primary Examiner* — Jason J Boeckmann
(74) *Attorney, Agent, or Firm* — Bose McKinney & Evans LLP

(57) ABSTRACT

A housing fluidly coupled to an inlet tube received within a faucet delivery spout. The housing receives a flow modifying device (e.g., an aerator or a stream straightener), and includes a first baffle and a second baffle to provide a desired water flow to the flow modifying device.

27 Claims, 9 Drawing Sheets

(56) References Cited

U.S. PATENT DOCUMENTS

| | | | | |
|---|---|---|---|---|
| 2016/0017579 | A1* | 1/2016 | Schurle | E03C 1/0403 137/315.01 |
| 2017/0152651 | A1* | 6/2017 | Staedtler | E03C 1/08 |

FOREIGN PATENT DOCUMENTS

| | | | |
|---|---|---|---|
| WO | 2008104206 | A1 | 9/2008 |
| WO | 2021123065 | A1 | 6/2021 |

* cited by examiner

HOUSING FOR A FLOW MODIFYING DEVICE

BACKGROUND AND SUMMARY OF THE DISCLOSURE

The present invention relates generally to a housing for a flow modifying device and, more particularly, to such a housing supported within a faucet delivery spout and fluidly coupled to a water supply tube.

The present disclosure relates to a housing facilitating the use of a conventional flow modifying device (e.g., an aerator or a stream straightener) with a polymer supply tube and thereby reducing water contact with the full width metal channel of a conventional faucet delivery spout. More particularly, the assembled supply tube, housing and flow modifying device reduces water interaction with metal and reduces potential water leaks. The illustrative housing uses a polymer body with spaced apart baffles to redistribute water flow in a desired manner to the flow modifying device.

As water enters the illustrative housing at an inlet opening, it contacts a first baffle downstream from the inlet opening to stop the water from directly hitting the flow modifying device (e.g., an aerator or a stream straightener). After the water stream contacts the first baffle of the illustrative housing, it then contacts a second baffle to further distribute the water flow to the flow modifying device. The structure of the housing permits transition to a prescribed flow cross-section from the supply tube. In an illustrative embodiment, the prescribed flow cross-section is such as to successfully engage with the inlet geometry of the flow modifying device to produce an outlet flow pattern that is the same as the outlet flow pattern produced from a rectangular full flow cross-section for which the flow modifying device was originally designed. The housing facilitates the use of a conventional flow modifying device (e.g., an aerator or a stream straightener) with a polymer supply tube (as opposed to water flowing through the full width of a metal channel of a conventional delivery spout). This reduces the water interaction with metal and helps reduce leaks by using existing polymer tubes.

According to an illustrative embodiment of the present disclosure, a water dispensing device includes a delivery spout having a passageway extending between an inlet end and an outlet end, and a housing supported by the outlet end of the delivery spout. The housing includes a body having an inlet opening defining a longitudinal axis. A flow modifying device is supported within the housing and is in fluid communication with the inlet opening. A polymer tube is fluidly coupled to the housing and extends within the passageway of the delivery spout. The housing includes a first baffle supported by the body and positioned downstream from the inlet opening to redirect water flow from the polymer tube in a lateral direction.

According to another illustrative embodiment of the present disclosure, a water dispensing device includes a housing having a body with an inlet opening defining a longitudinal axis. A flow modifying device is supported within the housing and is in fluid communication with the inlet opening. A polymer tube is fluidly coupled to the inlet opening of the housing. The housing includes a first baffle extending perpendicular to the longitudinal axis and configured to redirect water from the inlet opening, and a second baffle downstream from the first baffle, the second baffle extending parallel to the longitudinal axis and configured to redirect water from the first baffle.

According to a further illustrative embodiment of the present disclosure, a housing includes a body having an inlet opening defining a longitudinal axis. A first baffle extends perpendicular to the longitudinal axis and is configured to redirect water flow from the inlet opening (e.g., from an axial direction to a lateral direction). The first baffle includes a shelf supported by an arm coupled to the body. A second baffle is positioned downstream from the first baffle and includes a first fin and a second fin positioned on opposing sides of the first baffle. Each of the first fin and the second fin extend parallel to the longitudinal axis and are configured to redirect water flow from the first baffle.

Additional features and advantages of the present invention will become apparent of those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
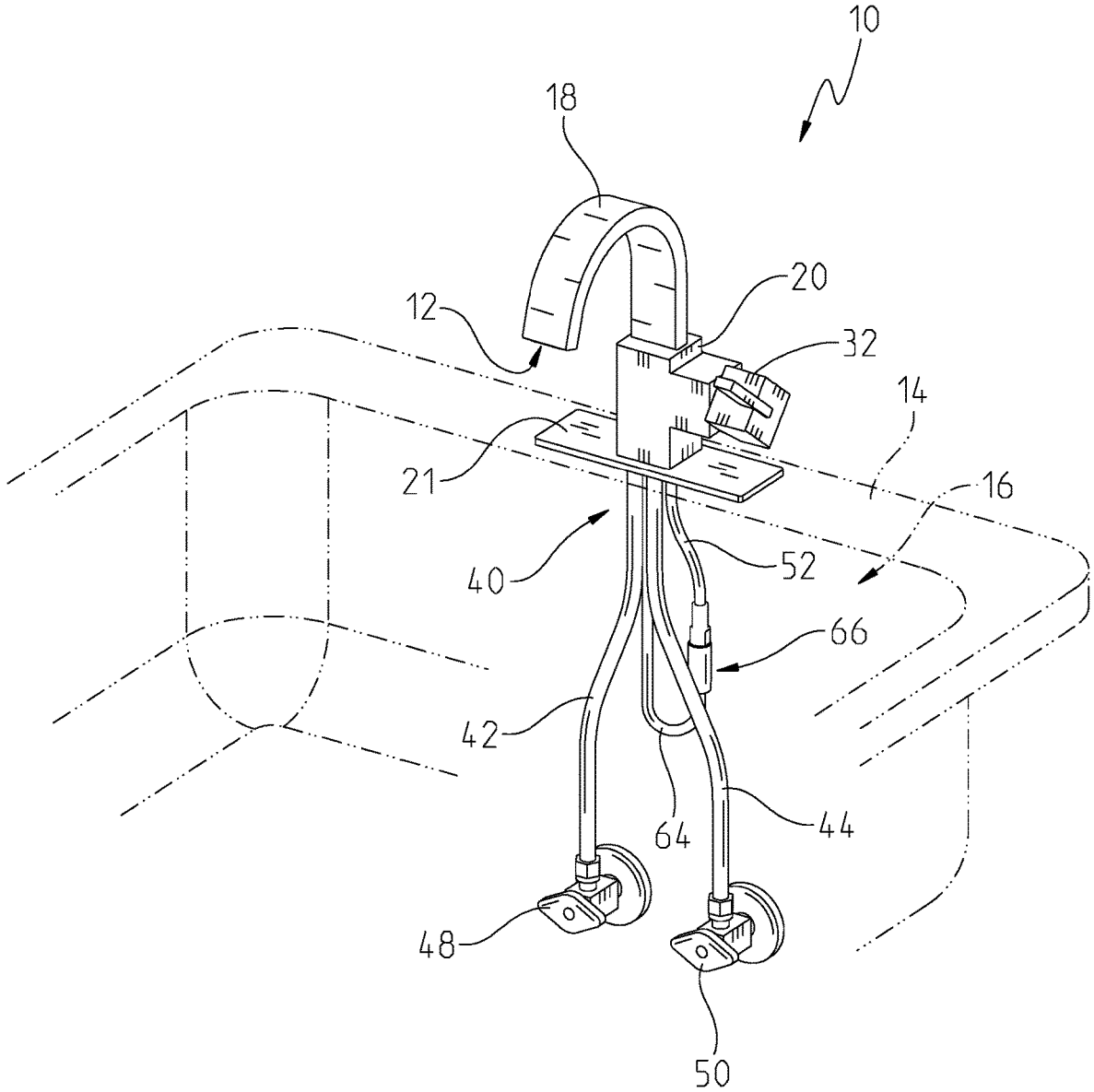
FIG. 1 is a perspective view of a faucet supported by a sink deck and including an illustrative housing of the present disclosure.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

Figure 2:
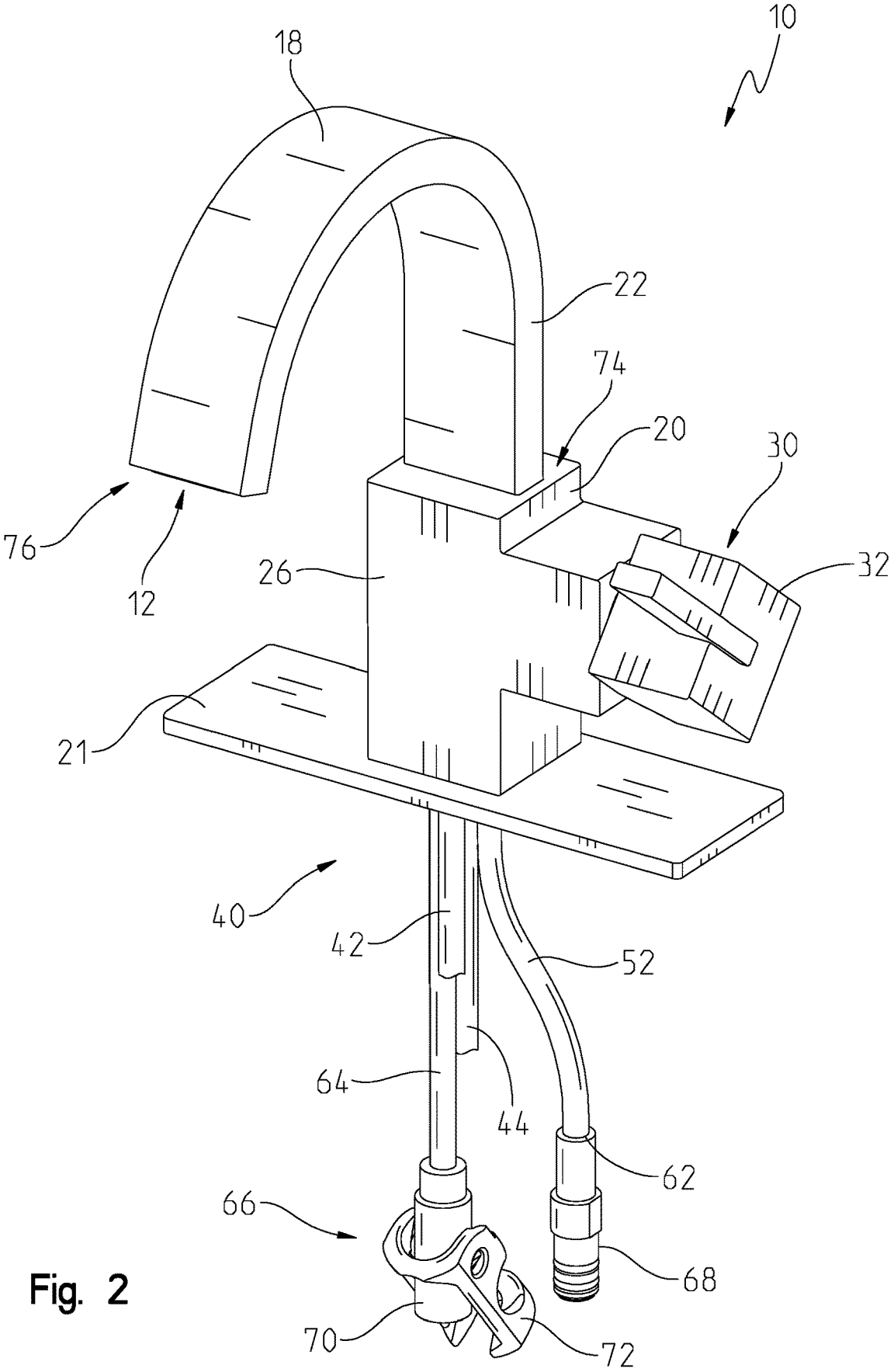
FIG. 2 is a perspective view of the faucet of FIG. 1.
Figure 3:
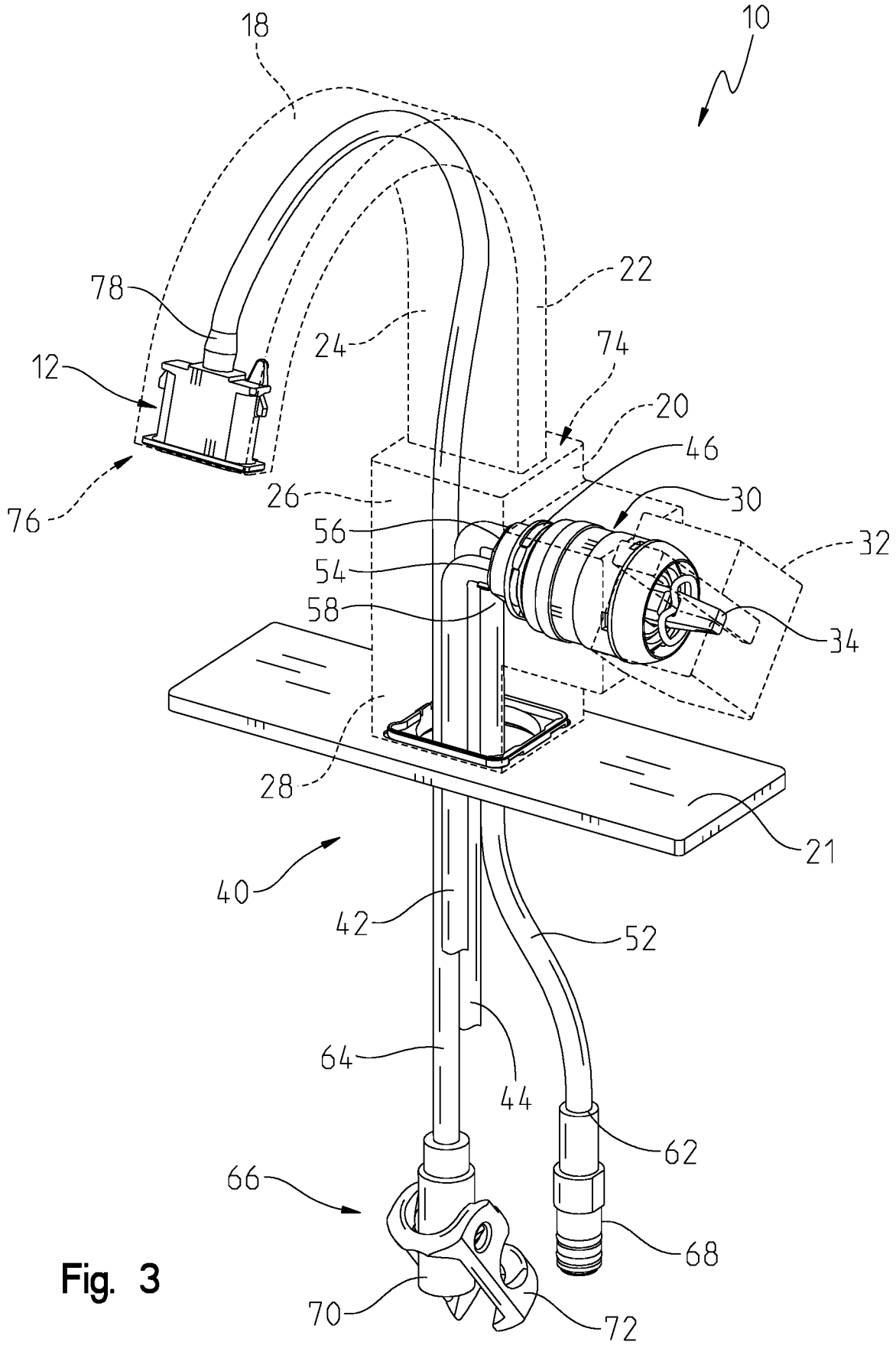
FIG. 3 is a perspective view of the faucet of FIG. 2, with portions of the delivery spout, the hub and the valve handle shown in phantom.
Figure 4:
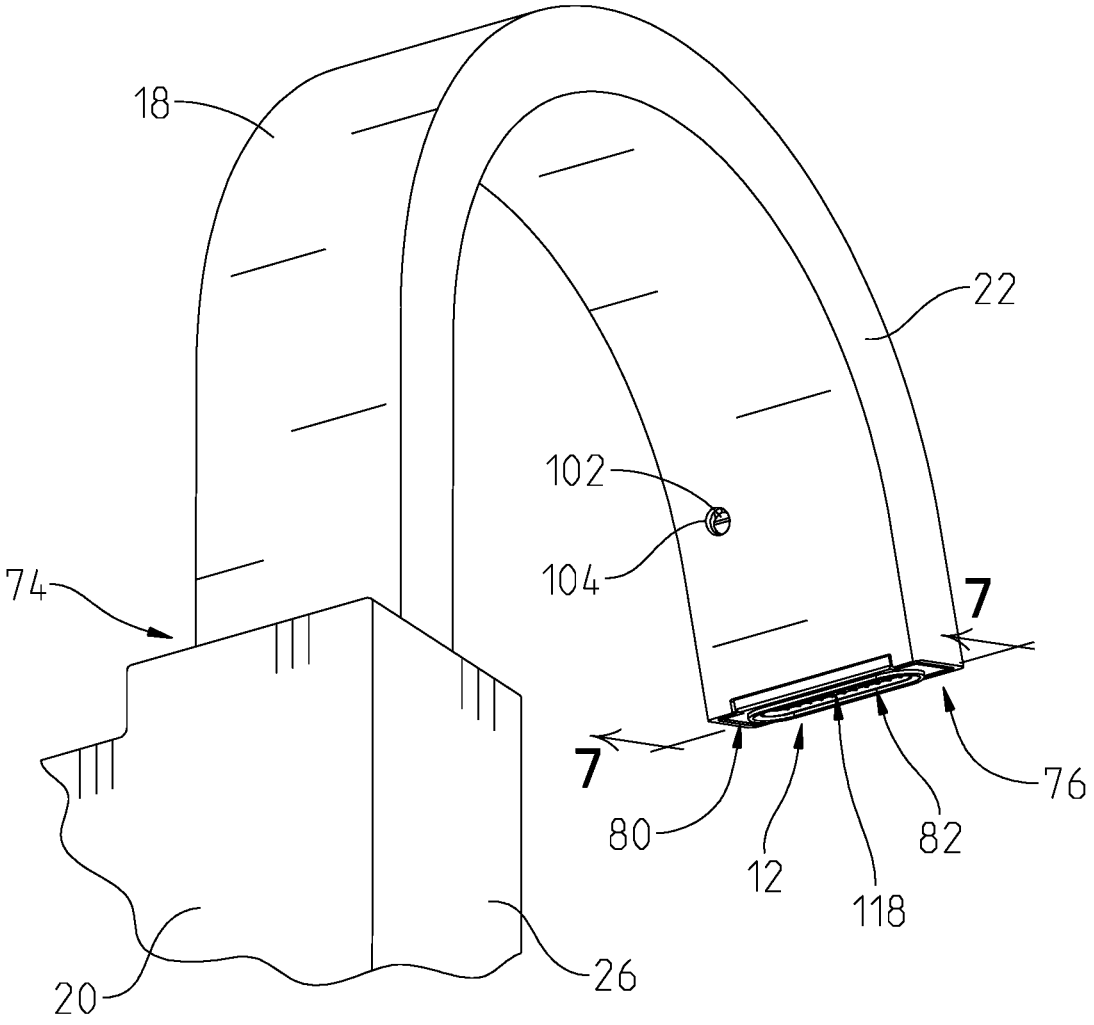
FIG. 4 is a rear perspective view of the delivery spout of the faucet of FIG. 2.

Referring initially to FIGS. 1 and 2, an illustrative faucet assembly 10 including a water dispensing device or flow modifying assembly 12 of the present disclosure is shown mounted to a sink deck 14 supporting a sink basin 16. The faucet assembly 10 illustratively includes a delivery spout 18 supported by a hub 20 positioned above a base plate 21. With reference to FIG. 3, the illustrative delivery spout 18 includes a sidewall 22 defining a passageway 24, and the illustrative hub 20 includes a sidewall 26 defining a passageway 28 in communication with the passageway 24. Both the delivery spout 18 and the hub 20 may be formed of a metal, such as plated brass.

With reference to FIG. 3, a valve assembly 30 is illustratively received within the hub 20. The valve assembly 30 illustratively includes a handle 32 configured to rotate a valve stem 34 operably coupled to a flow control member (not shown) to vary the flow rate and the temperature of water delivered to the water dispensing device 12. The valve assembly 30 may be of conventional design, such as that detailed in U.S. Pat. No. 7,753,074 to Rosko et al., the disclosure of which is expressly incorporated herein by reference.

As shown in FIG. 3, the faucet assembly 10 illustratively includes a waterway assembly 40 having a hot water supply line or tube 42 and a cold water supply line or tube 44 configured to supply hot and cold water, respectively, to the valve assembly 30 through an interface member 46. More particularly, the hot water supply tube 42 is fluidly coupled to a hot water supply 48 (e.g., a hot water supply valve or stop), while the cold water supply tube 44 is fluidly coupled to a cold water supply 50 (e.g., a cold water supply valve or stop)(FIG. 1). As noted above, operation of the valve assembly 30 regulates the flow of water from the hot water supply tube 42 and the cold water supply tube 44 to a mixed water or outlet tube 52.

Illustratively, the hot water supply tube 42 is fluidly coupled to a hot water inlet 54 of the valve assembly 30, and the cold water supply tube 44 is fluidly coupled to a cold water inlet 56 of the valve assembly 30. The outlet tube 52 includes a first end 58 fluidly coupled to an outlet (not shown) of the valve assembly 30, and a second end 62 fluidly coupled to a spout supply tube 64 extending through the passageway 24 of the delivery spout 18. A coupler 66 fluidly couples the outlet tube 52 with the spout supply tube 64, and illustratively includes a male connector 68 of the outlet tube 52 received within a female connector 70 of the spout supply tube 64. Illustratively, a flow regulator 71 is received within the female connector 70 (FIGS. 2 and 3). The coupler 66 illustratively includes a locking clip 72 for securing together the male connector 68 and the female connector 70. The tubes 42, 44, 52 and 64 may all be formed of a flexible polymer, illustratively a cross-linked polyethylene (PEX).

With further reference to FIGS. 2 and 3, the delivery spout 18 includes an inlet end 74 operably coupled to the hub 20, and an outlet end 76 supporting the water dispensing device 12. The supply tube 64 extends through the passageway 24 of the delivery spout 18 from the inlet end 74 to the outlet end 76. As further detailed herein, an outlet end 78 of the supply tube 64 is fluidly coupled to the water dispensing device 12.

Figure 5:
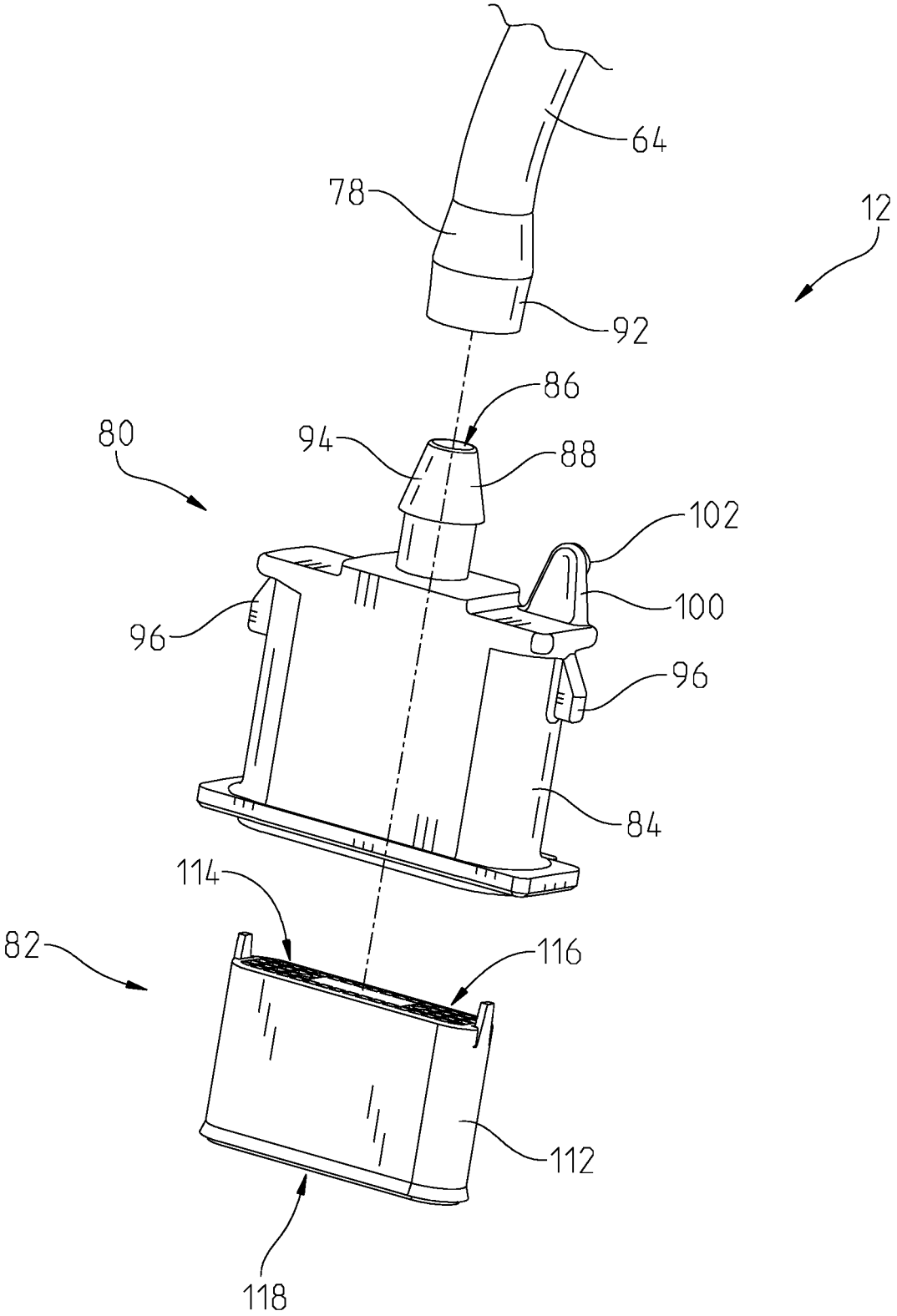
FIG. 5 is an exploded perspective view of the flow modifying device, the housing, and the supply tube of the faucet of FIG. 2.
Figure 6:
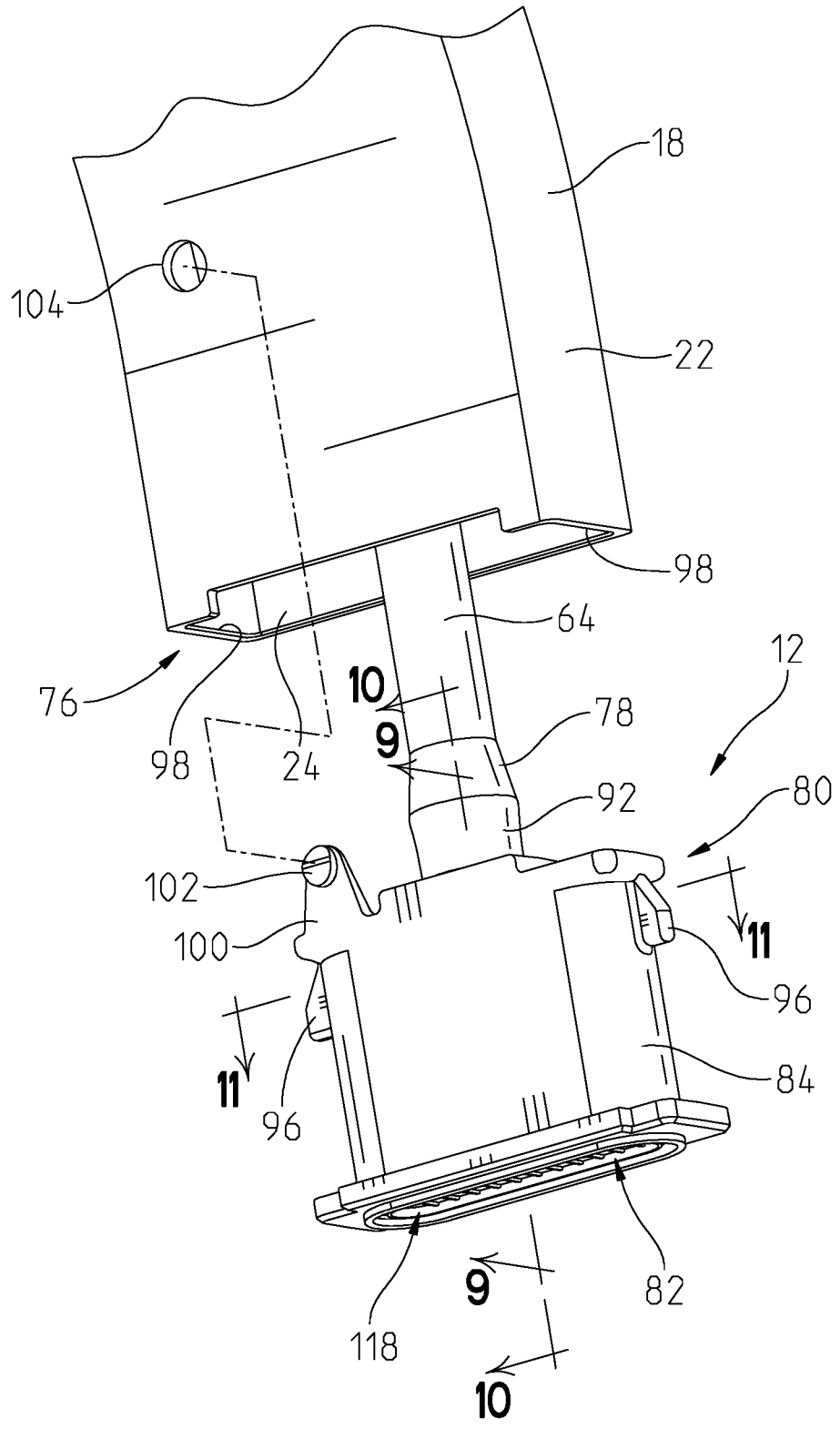
FIG. 6 is a partially exploded perspective view showing the housing and the flow modifying device fluidly coupled to the supply tube and removed from the outlet end of the delivery spout of the faucet of FIG. 4.
Figure 7:
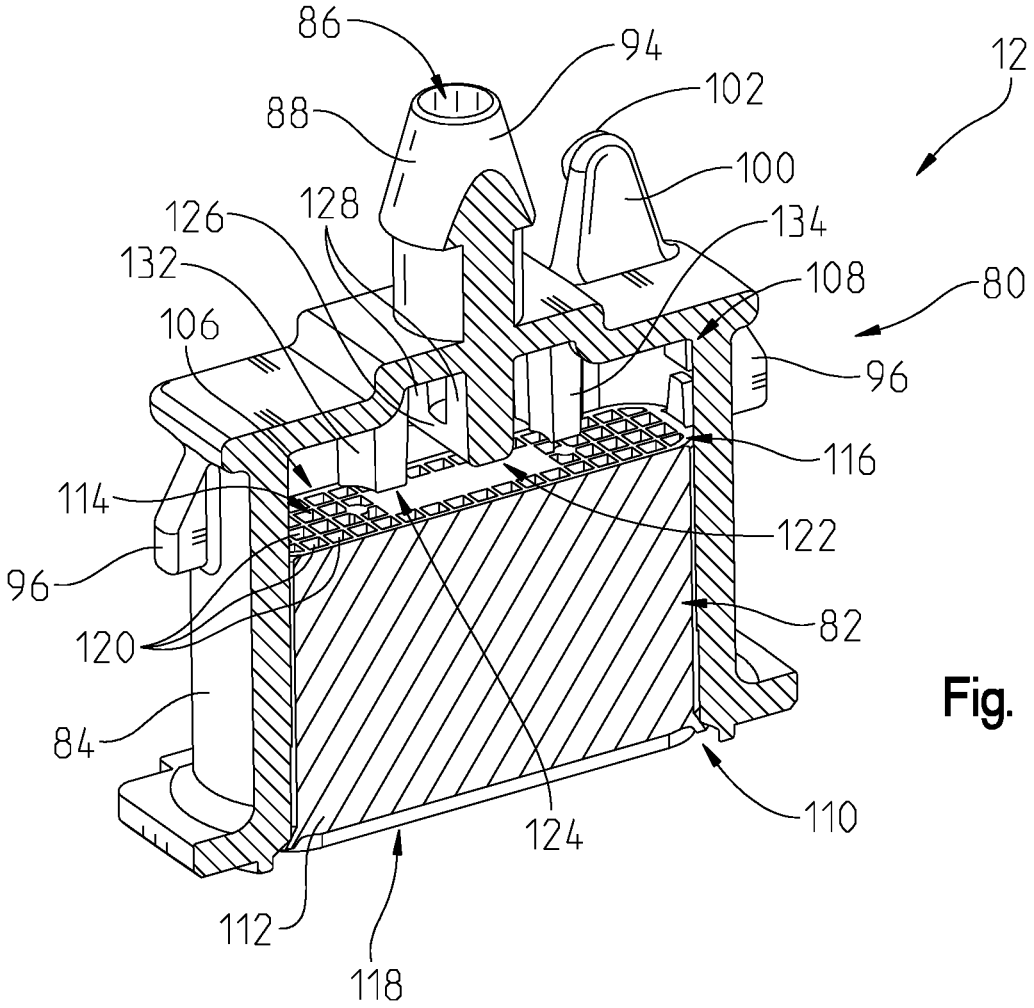
FIG. 7 is a cross-sectional view taken along line 7-7 of FIG. 4.

With reference to FIGS. 5-7, the water dispensing device 12 illustratively includes a flow modifying device housing 80 supported by the outlet end 76 of the delivery spout 18, and a flow modifying device 82 supported within the housing 80 and in fluid communication with the supply tube 64. The illustrative housing 80 includes a body 84 formed of a polymer, such as a nylon. Illustratively, the flow modifying device 82 may be an aerator or a stream straightener. As is known, an aerator modifies water flow by mixing air with water, while a stream straightener modifies water flow by removing turbulence and providing substantially laminar stream(s) of water.

Figure 8:
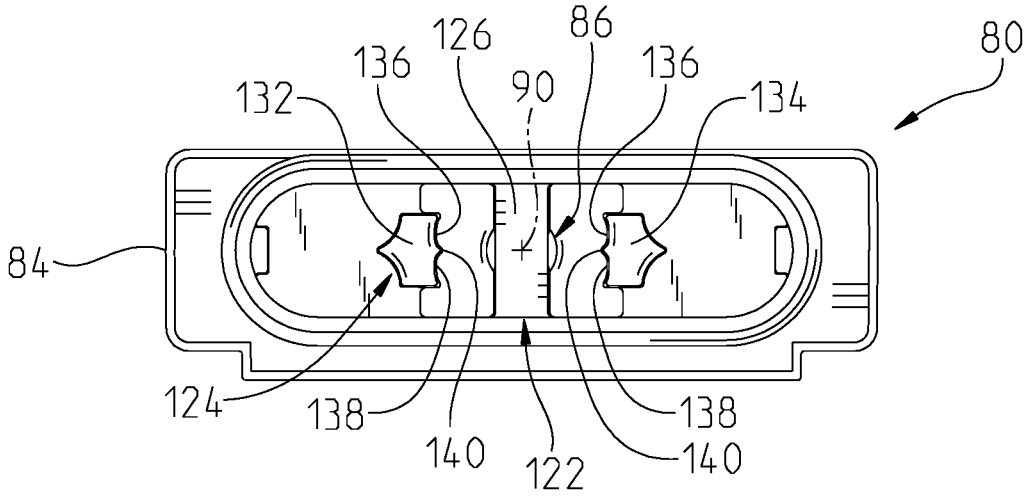
FIG. 8 is an end view of the illustrative housing of FIG. 5.
Figure 9:
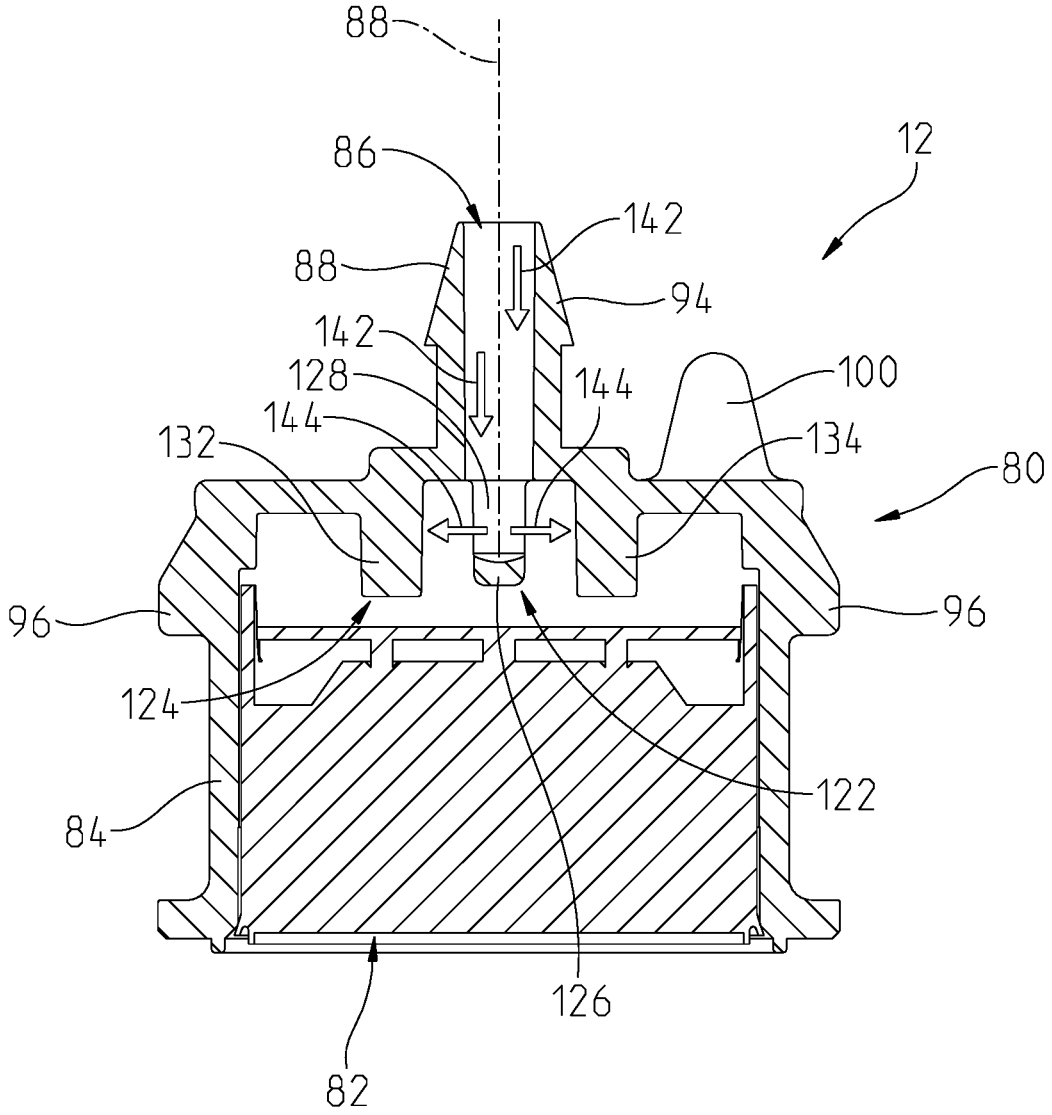
FIG. 9 is a cross-sectional view taken along line 9-9 of FIG. 6.
Figure 10:
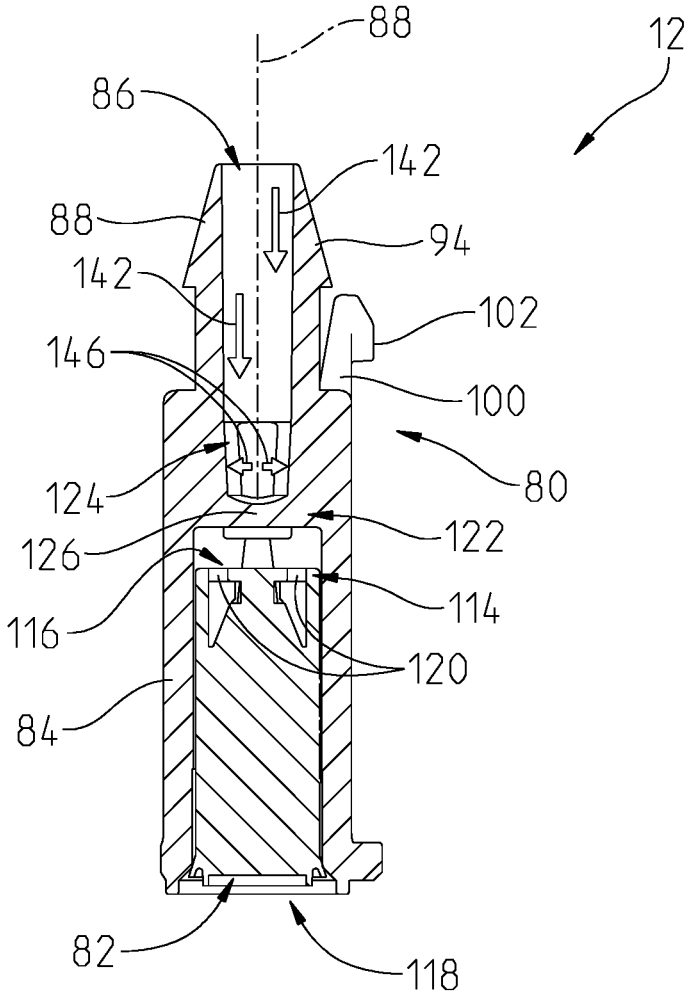
FIG. 10 is a cross-sectional view taken along line 10-10 of FIG. 6.

The housing 80 illustratively includes an inlet opening 86 defined by a nipple 88. The nipple 88 is illustratively received in sealing engagement within the supply tube 64. A longitudinal axis 90 is defined by the inlet opening 86 (FIGS. 8-10). The nipple 88 is illustratively received within an enlarged portion 92 at the outlet end 78 of the supply tube 64, wherein the inlet opening 86 is in fluid communication with the supply tube 64. More particularly, a frusto-conical member 94 of the nipple 88 is received within the enlarged portion 92 of the supply tube 64 to secure the housing 80 to the supply tube 64.

Opposing protrusions 96 are illustratively supported by the body 84 of the housing 80. More particularly, the opposing protrusions 96 extend laterally outwardly from the body 84 and engage an inner surface 98 of the delivery spout 18. A coupler 100 illustratively secures the housing 80 within the outlet end 78 of the delivery spout 18. The coupler 100 may include a resilient tab 102 received within a recess, illustratively an opening 104, formed within the sidewall 22 of the delivery spout 18.

The body 84 of the housing 80 illustratively includes a chamber 106 extending from an inlet end 108 and an outlet end 110. As noted above, the supply tube 64 is coupled to the housing 80 at the inlet end 108, and the flow modifying device 82 is received within the chamber 106 from the outlet end 110. The flow modifying device 82 may be secured within the chamber 106 of the housing 80 using conventional means, such as a friction fit, adhesives, fasteners, etc. In one illustrative embodiment, resilient tabs 112 may engage with the body 84 of the housing 80 to secure the flow modifying device 82 therein.

Figure 11:
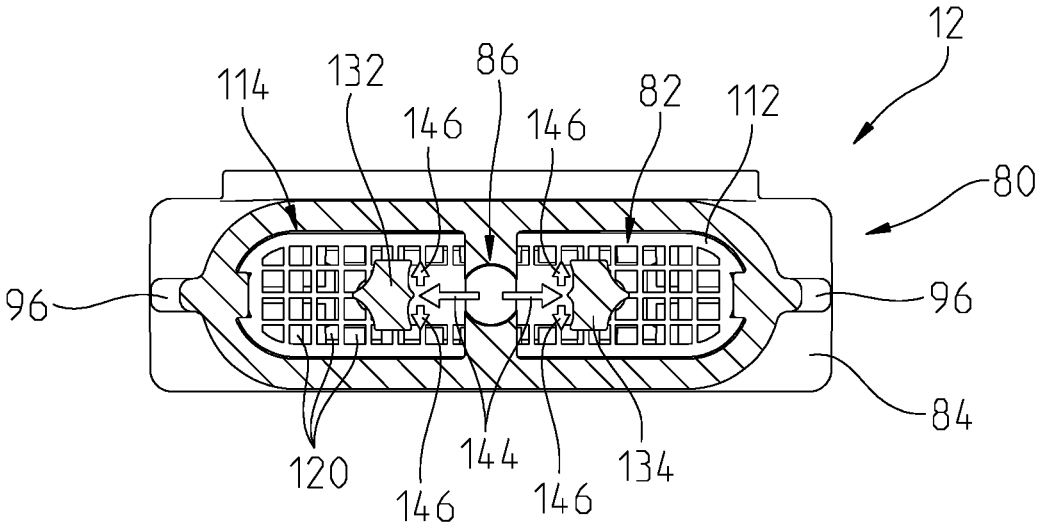
FIG. 11 is a cross-sectional view taken along line 11-11 of FIG. 6.

With reference to FIGS. 7 and 11, the illustrative flow modifying device 82 includes a body 112 formed of a polymer, such as a thermoplastic. Illustratively, the body 112 includes a grid structure 114 extending from an inlet 116 to an outlet 118. The grid structure 114 includes a plurality of axially extending openings or channels 120. The flow modifying device 82 may be of conventional design, and illustratively may be similar to that detailed in U.S. Pat. No. 8,561,922 to Staedtler, the disclosure of which is expressly incorporated herein by reference. In an illustrative embodiment, the flow modifying device 82 may be a rectangular aerator or stream straightener available from Neoperl of Mullheim, Germany (for example, Neoperl Part No. FS-RC-24X6).

With reference to FIGS. 7-10, the housing 80 includes a first baffle 122 supported by the body 84 and positioned downstream from the inlet opening 88 to redirect water flow from the inlet opening 88 in a lateral direction. Furthermore, the housing 80 includes a second baffle 124 supported by the body 84 and positioned downstream from the first baffle 122.

The first baffle 122 illustratively includes a lateral shelf 126 supported in spaced-relation to the inlet opening 86 by a plurality of circumferentially spaced arms 128 coupled to the body 84. The second baffle 124 illustratively includes a first fin 132 and a second fin 134 positioned on opposing sides of the first baffle 122. Illustratively, both the first fin 132 and second fin 134 extend in an axial direction (i.e., parallel to the longitudinal axis 88), and each include opposing curved surfaces 136 and 138 defining a peak 140 (FIG. 8).

In operation, when a user moves the valve handle 32, water flows through the respective hot water tube 42 and the cold water tube 44, through the valve assembly 30 and to the supply tube 64. Water flows from the supply tube 64 to the inlet opening 86 of the housing 80. The water flows axially as shown by arrows 142 in FIGS. 9 and 10, and then contacts the shelf 126 of the first baffle 122. As such, water from the inlet opening 86 is prevented from directly contacting the inlet 116 of the flow modifying device 82. The water then flows laterally in a perpendicular direction away from the longitudinal axis 90 until it contacts the fins 132 and 134 of the second baffle 124 as shown by arrows 144 in FIGS. 9 and 11. Upon contacting the fins 132 and 134 of the second baffle 124, the water is again redistributed in a prescribed manner (as represented by arrows 146 in FIGS. 10 and 11), such that a desired flow of water contacts the inlet end 116 of the flow modifying device 82. As may be appreciated, the first and second baffles 122 and 124 facilitate transition of water flow from the inlet opening to a fully developed cross-section.

Although the invention has been described in detail with reference to certain preferred embodiments, variations and modifications exist within the spirit and scope of the invention as described and defined in the following claims.

The invention claimed is:

1. A water dispensing device comprising:

a delivery spout including a passageway extending between an inlet end and an outlet end;

a housing supported by the outlet end of the delivery spout, the housing including a body defining a chamber and having an inlet opening defining a longitudinal axis;

a flow modifying device supported within the chamber and in fluid communication with the inlet opening;

a polymer tube fluidly coupled to the housing and extending within the passageway of the delivery spout; and wherein the housing includes a first baffle disposed within the chamber and supported by the body, the first baffle being positioned on the longitudinal axis downstream from the inlet opening to redirect water flow from the inlet opening in a lateral direction and wherein the housing includes a second baffle disposed in the chamber and supported by the body, the second baffle configured to redirect lateral fluid flow from the first baffle in a longitudinal direction.

2. The water dispensing device of claim 1, wherein the flow modifying device is secured within the chamber by a friction fit, adhesive, fastener or resilient tab and is positioned downstream from the second baffle.

3. The water dispensing device of claim 1, wherein the second baffle includes a first fin and a second fin, the first fin and the second fin positioned on opposing sides of the first baffle.

4. The water dispensing device of claim 3, wherein the first fin includes opposing curved surfaces defining a peak, and the second fin includes opposing curved surfaces defining a peak, wherein the peaks of the first and second fins both extend parallel with the longitudinal axis.

5. The water dispensing device of claim 2, wherein the first baffle includes a lateral shelf, and the second baffle includes an axial fin.

6. The water dispensing device of claim 1, wherein the first baffle includes a shelf supported in spaced relation to the inlet opening by a pair of spaced arms coupled to the body.

7. The water dispensing device of claim 1, wherein the housing includes a nipple received within the tube.

8. The water dispensing device of claim 1, wherein:

the delivery spout includes a sidewall defining the passageway and a recess formed within the sidewall; and the housing includes a coupler received within the recess of the delivery spout.

9. The water dispensing device of claim 1, wherein the flow modifying device includes a plurality of axially extending passageways defining a grid structure.

10. The water dispensing device of claim 1, wherein the housing is formed of a polymer, and the spout is formed of a metal.

11. A water dispensing device comprising:

a housing including a body defining a chamber and having an inlet opening defining a longitudinal axis;

a flow modifying device supported within the chamber and in fluid communication with the inlet opening;

a polymer tube fluidly coupled to the inlet opening of the housing; and wherein the housing includes a first baffle disposed within the chamber, positioned on and extending perpendicular to the longitudinal axis, and configured to redirect water flow from the inlet opening in a lateral direction, and a second baffle disposed in the chamber downstream from the first baffle, the second baffle extending parallel to the longitudinal axis and configured to redirect lateral water flow from the first baffle in a longitudinal direction.

12. The water dispensing device of claim 11, wherein the second baffle includes a first fin and a second fin, the first fin and the second fin positioned on opposing sides of the first baffle.

13. The water dispensing device of claim 12, wherein the first fin includes opposing curved surfaces defining a peak, and the second fin includes opposing curved surfaces defining a peak, wherein the peaks of the first and second fins both extend parallel with the longitudinal axis.

14. The water dispensing device of claim 11, wherein the first baffle includes a shelf supported in spaced relation to the inlet opening by a pair of spaced arms coupled to the body.

15. The water dispensing device of claim 11, wherein the housing includes a nipple received within the tube.

16. The water dispensing device of claim 11, wherein the housing includes a coupler configured to be received within a recess of a spout.

17. The water dispensing device of claim 16, wherein the coupler includes a resilient tab supported by the body.

18. The water dispensing device of claim 11, wherein the flow modifying device includes a plurality of axially extending passageways defining a grid structure.

19. The water dispensing device of claim 11, wherein the housing is formed of a polymer.

20. The water dispensing device of claim 11, wherein the flow modifying device is secured within the chamber by a friction fit, adhesive, fastener or resilient tab and is positioned downstream of the second baffle.

21. A housing for a flow modifying device comprising:

a body defining a chamber and including an inlet opening defining a longitudinal axis;

a first baffle disposed within the chamber, the first baffle being positioned on and extending perpendicular to the longitudinal axis and configured to redirect water flow from the inlet opening in a lateral direction, the first baffle including a shelf extending between and supported by a pair of arms coupled to the body; and a second baffle disposed within the chamber downstream from the first baffle, the second baffle including a first fin and a second fin, the first fin and the second fin positioned on opposing sides of the first baffle, each of the first fin and the second fin extending parallel to the longitudinal axis and configured to redirect lateral water flow from the first baffle in a longitudinal direction.

22. The housing of claim 21, wherein the first fin includes opposing curved surfaces defining a peak, and the second fin includes opposing curved surfaces defining a peak, wherein the peaks of the first and second fins both extend parallel with the longitudinal axis.

23. The housing of claim 21, wherein the housing includes a nipple received within a tube.

24. The housing of claim 21, wherein the housing includes a coupler received within a recess of a spout.

25. The housing of claim 24, wherein the coupler includes a resilient tab supported by the body.

26. The housing of claim 21, wherein the body is formed of a polymer.

27. The housing of claim 21, further comprising a flow modifying device secured within the chamber, the flow modifying device being in fluid communication with the inlet opening and positioned downstream of the second baffle.

* * * * *